US005695829A

United States Patent [19]

Quincy, III et al.

[11] Patent Number: 5,695,829

[45] Date of Patent: Dec. 9, 1997

[54] MODIFIED POLYMERIC MATERIAL HAVING IMPROVED WETTABILITY

[75] Inventors: Roger Bradshaw Quincy, III, Alpharetta; Ronald Sinclair Nohr, Roswell; Elizabeth Deibler Gadsby, Marietta, all of Ga.

[73] Assignee: Kimberly-Clark Worldwide, Inc., Neenah, Wis.

[21] Appl. No.: 719,595

[22] Filed: Sep. 25, 1996

Related U.S. Application Data

[63] Continuation of Ser. No. 494,215, Jun. 23, 1995, abandoned.

[51] Int. Cl.[6] ..... B01J 19/10; B05D 3/12

[52] U.S. Cl. ..... 427/560; 427/600; 427/601

[58] Field of Search ..... 427/560, 565, 427/600, 601

[56] References Cited

U.S. PATENT DOCUMENTS

| | | | |
|---|---|---|---|
| 3,338,992 | 8/1967 | Kinney | 264/24 |
| 3,341,394 | 9/1967 | Kinney | 161/72 |
| 3,502,763 | 3/1970 | Hartmann | 264/210 |
| 3,542,615 | 11/1970 | Dobo et al. | 156/181 |
| 3,692,618 | 9/1972 | Dorschner et al. | 161/72 |
| 3,802,817 | 4/1974 | Matsuki et al. | 425/66 |
| 3,892,573 | 7/1975 | Tatsuta et al. | 96/67 |
| 4,233,075 | 11/1980 | Picone | 106/3 |
| 4,302,485 | 11/1981 | Last et al. | 427/57 |
| 4,306,551 | 12/1981 | Hymes et al. | 128/156 |
| 4,307,717 | 12/1981 | Hymes et al. | 128/156 |
| 4,340,563 | 7/1982 | Appel et al. | 264/518 |
| 4,391,749 | 7/1983 | Engvall et al. | 260/123 |
| 4,591,501 | 5/1986 | Cioca | 424/28 |
| 4,637,834 | 1/1987 | Thurow | 106/124 |
| 4,638,023 | 1/1987 | Trasch et al. | 524/21 |
| 4,689,381 | 8/1987 | Krinski et al. | 527/201 |
| 4,818,291 | 4/1989 | Iwatsuki et al. | 106/124 |
| 4,828,561 | 5/1989 | Woodroof | 623/9 |
| 5,207,941 | 5/1993 | Kroner et al. | 252/174 |
| 5,209,776 | 5/1993 | Bass et al. | 106/124 |
| 5,272,074 | 12/1993 | Rubens | 435/180 |
| 5,336,534 | 8/1994 | Nakajima et al. | 427/600 |
| 5,376,402 | 12/1994 | Louks et al. | 427/8 |

OTHER PUBLICATIONS

"Application of freezing front technique and axisymmetric drop shape analysis–profile for the determination of surface tensions of adsorbed protein layers", Colloids and Surfaces B: Biointerfaces, vol. 1, 1993, pp. 23–32.

"Novel materials from protein–polymer grafts", Nature, vol. 325, Jan. 22, 1987, pp. 328–329.

"Breathable Fabrics Made By Coating With Amino Acids", Nonwovens World, Aug. 1986, pp. 76–80.

"Immobilization of Glucose Oxidase on Nonwoven Fabrics with Bombyx mori Silk Firboin Gel", Journal of Applied Polymer Science, vol. 46, 1992, pp. 49–53.

"Decolorizing Dye Wastewater using Chitosan", American Dyestuff Reporter, Oct. 1993, pp. 18–38.

"The Plasma Proteins", The Roster of the Plasma Proteins, Copr. 1975, pp. 111–113, 133–134, 140–141, 146–147, 151–152, 154–155, 167–168.

*Primary Examiner*—Erma Cameron

*Attorney, Agent, or Firm*—David J. Alexander; William E. Maycock

[57] ABSTRACT

Proteins are applied to a polymeric article by contacting the polymeric article with a protein and exposing the contacted polymeric article to a frequency with a sufficient power dissipation for a sufficient period of time. A frequency range for applying proteins to a polymeric article is between about 5 kHz to about 40 kHz with a minimum power dissipated of about 1 watt. As a result, polymeric articles so treated exhibit improved water wettability, proteins may be applied to the polymeric articles very rapidly and more uniformly than by other methods, and polymeric articles having selected zones of wettability may be produced.

25 Claims, No Drawings

MODIFIED POLYMERIC MATERIAL HAVING IMPROVED WETTABILITY

This application is a continuation of application Ser. No. 08/494,215 entitled "Modified Polymeric Material Having Improved Wettability" and filed in the U.S. Patent and Trademark Office on Jun. 23, 1995 now abandoned. The entirety of this application is hereby incorporated by reference.

FIELD OF THE INVENTION

The present invention relates to coatings for polymeric articles. More particularly, the present invention relates to hydrophilic coatings for nonwoven polyolefin fabrics.

BACKGROUND OF THE INVENTION

Generally, polymer materials and articles formed from polymers are sometimes classified in one of two groups, i.e., hydrophilic or hydrophobic, based upon the polymer surface affinity for water. Generally, if the polymer is water wettable or the polymer absorbs water or in someway unites with or takes up water, then the polymer is considered "hydrophilic". Generally, if the polymer is not water wettable or repels water or in someway does not unite with or absorb water, then the polymer is considered "hydrophobic".

When selecting an appropriate polymer for forming or incorporation into a product many factors, including the water affinity property of a polymer, are considered. Other factors may include, for example, polymer costs, availability, polymer synthesis, environmental concerns, ease of handling, and current product composition. In some instances, it may be more feasible to employ a water repellent or hydrophobic polymer in a product designed to absorb water or an aqueous liquid than to use a water absorbent or hydrophilic polymer. In other instances it may be more feasible to employ a water absorbent or hydrophilic polymer in a product designed to repel water or an aqueous liquid than to use a water repellent or hydrophobic polymer. Generally, in these instances, the selected polymer or polymer surface must be modified to conform to the intended use of the polymer in the ultimate product.

Examples of hydrophobic polymers which traditionally have been modified for hydrophilic uses are polyolefins, such as polyethylene and polypropylene. These polymers are used to manufacture polymeric fabrics which are incorporated into disposable articles for absorbing aqueous liquids or aqueous suspensions, such as for example, menses. Examples of these absorbent articles include diapers, feminine care products, incontinence products, training pants, wipes, surgical drapes and the like. Such polymeric fabrics often are nonwoven webs prepared by, for example, such processes as meltblowing, coforming, and spunbonding.

Generally, such polymer surface modifications are typically either durable or non-durable. In the case of polymer compositions having hydrophobic surfaces, generally, non-durable hydrophilic treatments include topical applications of one or more surface active agents or surfactants. Some of the more common topically applied surfactants include non-ionic surfactants, such as polyethoxylated octylphenols and condensation products of propylene oxide with propylene glycol. Methods of topical application include, for example, spraying or otherwise coating the polymer fabric with a surfactant solution during or after the polymer fabric formation, and then drying the polymer fabric. However, topically applied surfactants are generally easily removed from the fabric, and in some cases after only a single exposure to an aqueous liquid. Additionally, the solubilization of the surfactant in the aqueous liquid generally lowers the surface tension of the aqueous liquid. In these instances, the reduced surface tension of the aqueous liquid may permit the aqueous liquid to be absorbed by or pass through other portions of the fabric or other fabric layers which would have otherwise repelled the aqueous liquid had its surface tension not been lowered by the presence of the solubilized surfactant.

Generally, more durable methods of modifying polymer compositions include a number of wet chemical techniques and radiation techniques which initiate a chemical reaction between the polymer and a water affinity altering material.

Wet chemical techniques include, but are not limited to oxidation, acid or alkali treatments, halogenation and silicon derivative treatments. Radiation techniques which produce free radicals in the polymer include, but are not limited to, plasma or glow discharge, ultraviolet radiation, electron beam, beta particles, gamma rays, x-rays, neutrons and heavy charged particles.

Many of these radiation techniques and wet chemical techniques may be relatively expensive, present environmental concerns and/or in some instances are incompatible with processes for forming a polymeric article. Therefore, there exists a need for a more durable polymer surface modification than presently available by topically applied surfactants while at the same time avoiding the economical and/or environmental drawbacks of traditional durable polymer surface modification methods.

SUMMARY OF THE INVENTION

In response to the above problems encountered by those skilled in the art, the present invention provides articles having a material applied thereon and methods for applying such material. The presence of such material on a surface of such articles imparts hydrophilic properties to the applied surfaces. These materials may include one or more proteins. Examples of such proteins include fibrinogen, beta casein, gelatin, hemoglobin, and lysozyme. Examples of such articles include polymeric woven and nonwoven articles, and particularly nonwoven polyolefin fabrics.

Typically, the articles may include articles formed from polymeric compositions. Such polymeric articles will be in a form possessing one or more surfaces. More particularly, the polymeric article to be coated may be a nonwoven web and/or film or a combination thereof. Such polymeric articles may be formed from one or more thermoplastic polymers and particularly one or more polyolefin polymers.

In one embodiment, the process for applying a protein to a polymeric article includes bringing the polymeric article into physical contact with a protein and exposing the protein-contacted polymeric article to a frequency with a sufficient power dissipation for a sufficient period of time to apply the protein to the polymeric composition. Desirably, the frequency is generally within the range of at least 5 kHz, and more desirably, the frequency is between about 5 kHz to about 40 kHz, and still more desirably, the frequency is within the range of between about 15 kHz to about 25 kHz, and most desirably, the frequency is within the range of between about 19 kHz to about 21 kHz. Still more desirably, the frequency may be within the frequency range which defines ultrasonic frequencies. Desirably, the power dissipated is at least 1 watt, and desirably, all ranges there in. More desirably, the power dissipated is at least 10 watts, and still more desirably, the power dissipated is at least 20 watts, and still more desirably, the power dissipated is at least 30 watts, and most desirably, the power dissipated is at least 40 watts.

In one embodiment, the polymeric article is brought into physical contact with a protein by contacting the polymeric article with a solution containing the protein therein. Generally, it is desirable that the protein be at least partially soluble in such solution. Examples of suitable solutions may include an aqueous solution and more particularly an aqueous buffered solution or a water/alcohol solution. In this embodiment, it is desirable that the frequency and the power dissipated be sufficient to produce cavitation within the solution.

DETAILED DESCRIPTION OF THE INVENTION

The term "protein" is meant to include any protein, including both simple proteins and such conjugated proteins as, by way of example only, nucleoproteins, lipoproteins, glycoproteins, phosphoproteins, hemoproteins, flavoproteins, and metalloproteins. Thus, the term is meant to encompass, without limitation, enzymes, storage proteins, transport proteins, contractile proteins, protective proteins, toxins, hormones, and structural proteins, by way of illustration only. In addition, the term includes a single protein and/or a mixture of two or more proteins.

As used herein, the term "nonwoven web" refers to a web that has a structure of individual fibers or filaments which are interlaid, but not in an identifiable repeating manner.

As used herein the term "spunbond fibers" refers to fibers which are formed by extruding molten thermoplastic material as filaments from a plurality of fine, usually circular capillaries of a spinnerette with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. Nos. 3,502,763 and 3,909,009 to Levy, and U.S. Pat. No. 3,542,615 to Dobo et al which are all herein incorporated by reference.

As used herein the term "meltblown fibers" means fibers formed by extruding a molten thermoplastic material through a plurality of fine, usually circular, die capillaries as molten threads or filaments into a high velocity, usually heated gas (e.g. air) stream which attenuates the filaments of molten thermoplastic material to reduce their diameter. Thereafter, the meltblown fibers are carried by the high velocity gas stream and are deposited on a collecting surface to form a web of randomly disbursed meltblown fibers. Meltblowing is described, for example, in U.S. Pat. No. 3,849,241 to Buntin, U.S. Pat. No. 4,307,143 to Meitner et al., and U.S. Pat. No. 4,707,398 to Wisneski et al which are all herein incorporated by reference.

The term "polymeric fabric" means any woven structure, nonwoven structure or film structure formed from a polymeric material. Such film structures may be either porous or non-porous. When the polymeric fabric is in the form of either a woven or nonwoven structure, it will be understood that such structure may be composed, at least in part, of fibers of any length. Thus, the fabric can be a woven or nonwoven sheet or web, all of which are readily prepared by methods well-known to those of ordinary skill in the art. For example, nonwoven webs are prepared by such processes as meltblowing, coforming, spunbonding, carding, air laying, and wet laying.

The polymeric fabric can consist of a single layered fabric, a plurality of distinct single layered fabrics, a multiple-plied fabric or a plurality distinct multiple-plied fabrics. Processes for bonding polymeric fabrics so as to form such layered and laminated structures are well-known by those skilled in the art. In addition, such polymeric fabrics may be formed from a combination of woven, nonwoven or film structures.

Polymeric materials may be synthetic or natural, although the former are more likely to be employed in the present invention. Examples of natural polymeric materials include, cotton, silk, wool, and cellulose, by way of illustration only.

Synthetic polymeric materials, in turn, can be either thermosetting or thermoplastic materials, with thermoplastic materials being more common. Examples of thermosetting polymers include, by way of illustration only, alkyd resins, such as phthalic anhydride-glycerol resins, maleic acid-glycerol resins, adipic acid-glycerol resins, and phthalic anhydride-pentaerythritol resins; allylic resins, in which such monomers as diallyl phthalate, diallyl isophthalate diallyl maleate, and diallyl chlorendate serve as nonvolatile cross-linking agents in polyester compounds; amino resins, such as aniline-formaldehyde resins, ethylene urea-formaldehyde resins, dicyandiamide-formaldehyde resins, melamine-formaldehyde resins, sulfonamide-formaldehyde resins, and urea-formaldehyde resins; epoxy resins, such as cross-linked epichlorohydrin-bisphenol A resins; phenolic resins, such as phenol-formaldehyde resins, including Novolacs and resols; and thermosetting polyesters, silicones, and urethanes.

Examples of thermoplastic polymers include, by way of illustration only, end-capped polyacetals, such as poly (oxymethylene) or polyformaldehyde, poly (trichloroacetaldehyde) , poly(n-valeraldehyde), poly (acetaldehyde), poly-(propionaldehyde), and the like; acrylic polymers, such as polyacrylamide, poly(acrylic acid), poly (methacrylic acid), poly(ethyl acrylate), poly (methyl methacrylate), and the like; fluorocarbon polymers, such as poly (tetrafluoroethylene), perfluorinated ethylene-propylene copolymers, ethylene-tetrafluoroethylene copolymers, poly(chloro-trifluoroethylene), ethylene-chlorotrifluoroethylene copolymers, poly(vinylidene fluoride), poly(vinyl fluoride), and the like; polyamides, such as poly(ε-aminocaproic acid) or poly(ε-caprolactam) , poly-(hexamethylene adipamide), poly(hexamethylene sebacamide), poly(11-aminoundecanoic acid), and the like; polyaramides, such as poly(imino-1,3-phenyleneiminoisophthaloyl) or poly (m-phenylene isophthalamide), and the like; parylenes, such as poly-p-xylylene, poly(chloro-p-xylylene), and the like; polyaryl ethers, such as poly(oxy-2,6-dimethyl-1,4-phenylene) or poly (p-phenylene oxide), and the like; polyaryl sulfones, such as poly(oxy-1,4-phenylenesulfonyl-1,4-phenyleneoxy-1,4-phenylene-isopropylidene-1,4-phenylene), poly (sulfonyl-1,4-phenyleneoxy-1,4-phenylenesulfonyl- 4,4'-biphenylene), and the like; polycarbonates, such as poly (bisphenol A) or poly(carbonyldioxy-1,4-phenyleneisopropylidene-1,4-phenylene), and the like; polyesters, such as poly(ethylene terephthalate), poly (tetramethylene terephthalate), poly-(cyclohexylene-1,4-dimethylene terephthalate) or poly(oxy-methylene-1,4-cyclohexylenemethyleneoxyterephthaloyl), and the like; polyaryl sulfides, such as poly(p-phenylene sulfide) or poly (thio-1,4-phenylene), and the like; poly-imides, such as poly(pyromellitimido-1,4-phenylene), and the like; polyolefins, such as polyethylene, polypropylene, poly(1-butene), poly(2-butene), poly(1-pentene), poly(2-pentene), poly(3-methyl-1-pentene), poly(4-methyl-1-pentene), 1,2-poly-1,3-butadiene, 1,4-poly-1,3-butadiene, polyisoprene, polychloroprene, polyacrylonitrile, poly(vinyl acetate), poly (vinylidene chloride), polystyrene, and the like; copolymers of the foregoing, such as acrylonitrile-butadiene-styrene (ABS) copolymers, and the like.

The present invention provides articles, and particularly articles formed from polymeric materials, having a material applied thereon and methods for applying such material. The presence of such material on a surface of such articles imparts hydrophilic properties to the applied surfaces. These materials may include one or more proteins. Examples of such proteins include fibrinogen, beta casein, gelatin, hemoglobin and lysozyme.

Examples of articles formed from polymeric materials include polymeric fabrics. Examples of polymeric fabrics include woven and nonwoven structures, and particularly nonwoven fabrics formed from one or more polyolefins. Such nonwoven structures may be formed from spunbond fibers, meltblown fibers or a combination of spunbond fibers and meltblown fibers. Generally, however, such articles will be in a form possessing one or more surfaces and such polymeric articles may be formed from one or more thermoplastic polymers and particularly one or more polyolefin polymers.

In one embodiment, the fibers of a nonwoven polymeric fabric and more particularly a nonwoven polyolefin polymeric fabric may be formed from either a homopolymer, co-polymer, two or more polymers or a combination thereof. When the fibers are formed from a combination of two or more polymers, such polymers may be randomly blended or formed by well-known processes into a bi-component structure. In the case of the bi-component structure, the orientation of the polymers within the fiber may be sheath/core or side-by-side.

In one embodiment, the process for applying a protein to a polymeric article includes bringing the polymeric article into physical contact with a protein and exposing the protein-contacted polymeric article to a frequency with a sufficient power dissipation for a sufficient period of time to apply the protein to the polymeric composition. Desirably, the frequency is generally within the range of at least 5 kHz, and more desirably, the frequency is between about 5 kHz to about 40 kHz, and still more desirably, the frequency is within the range of between about 15 kHz to about 25 kHz, and most desirably, the frequency is within the range of between about 19 kHz to about 21 kHz. Still more desirably, the frequency may be within the frequency range which defines ultrasonic frequencies. Desirably, the power dissipated is at least 1 watt, and desirably, all ranges there in, and more desirably, the power dissipated is at least 10 watts, and still more desirably, the power dissipated is at least 20 watts, a still more desirably, the power dissipated is at least 30 watts, and most desirably, the power dissipated is at least 40 watts.

In one embodiment, the polymeric article is brought into physical contact with a protein by contacting the polymeric article with a solution containing the protein therein. Generally, it is desirable that the protein be at least partially soluble in such solution. Examples of suitable solutions may include an aqueous solution and more particularly an aqueous buffered solution or a water/alcohol solution. In this embodiment, it is desirable that the frequency and the power dissipated be sufficient to produce cavitation within the solution.

Ultrasonic frequency sources are well known to one of ordinary skill in the art. Generally, the principle components of ultrasonic frequency sources include a power supply, a converter and a horn. The power supply transforms AC line voltage to electrical energy. This electrical energy is directed to the converter. The converter transforms the electrical energy into mechanical vibrations. From the converter, the mechanical vibrations (generally in the form of longitudinal directed vibrations) are transmitted to the tip of the horn. The tip of the horn may be in contact with a solution. The article may also be in contact with the same solution. Furthermore, the tip of the horn may be in direct contact with the article, wherein such article may be in or out of the solution.

The horn tips are available in a variety of dimensions. For example, circular cross sectional horn tips are available in various diameters. Other horn tips are available having greater length dimensions than width dimensions. These latter horns are sometimes referred to as "blade" horns.

In one embodiment, the polymeric article is brought into physical contact with a protein by contacting the polymeric article with a solution containing a quantity of solubilized protein. The solubilized protein solution may be applied to the polymeric fabric by any number of techniques, such as for example, soaking, immersing or spraying. Solvents for solubilizing the proteins may include: deionized-distilled water; a solution of 99.5% deionized, distilled water and 0.5% hexanol; and a pH buffered solution, and particularly, a pH buffered solution wherein the pH of the solution is between about 4 and to about 9, and desirably wherein the pH of the solution is between about 6 to about 8, and more desirable wherein the pH of the solution is about 7.

In one embodiment, the polymeric article is brought into physical contact with a protein by immersing the polymeric article in a solution of solubilized protein. In this embodiment, the horn may also be immersed in the protein solution. It is desirable that the tip of the horn be immersed at least ¼ inch into the protein solution and more desirably, the tip of the horn be immersed from about between ¼ inch to about 2 inches into the protein solution. Furthermore, the immersed polymeric article may be positioned in close proximity to the tip of the horn. More particularly, the polymeric article may be positioned directly beneath the tip of the horn and between 1/16 inch and 3 inches away from the tip of the horn. Alternatively, the immersed polymeric article may be positioned in physical contact with the tip of the horn.

Depending upon the shape of the polymeric article, there are several alternatives or readily apparent alternatives available to those skilled in the art for securing the immersed polymeric article in the protein solution. In those instances when the polymeric article is a sheet of polymeric fabric, the sheet of polymeric fabric may be secured between two engaging surfaces, such as a pair of concentric engaging rings. By securing the engaging surfaces so that the engaging surfaces are vertically adjustable relative to the protein solution, the depth of immersion of the polymeric fabric may be selected. By securing the horn so that the tip of the horn is vertically adjustable relative to the protein solution, the distance between the tip of the horn and the fabric may also be selected.

In those instances when the polymeric article is a roll of polymeric fabric, the apparatus described in U.S. Pat. No. 4,302,485, issued Nov. 24, 1981 to Last et al., and incorporated herein by reference, may be used.

Additionally, in those instances when the polymeric fabric is formed from two or more layers of individual polymeric fabrics, the protein may be applied by the methods of the present invention to one or more layers of such polymeric fabrics.

To demonstrate the attributes of the present invention, the following examples are provided. Such examples, however, are not to be construed as limiting in any way either the spirit or scope of the present invention.

EXAMPLES

In order to illustrate the forgoing invention, several protein-coated polymeric fabrics were prepared. The proteins utilized in the following examples were, bovine fibrinogen (hereafter "fibrinogen"), beta casein from bovine milk (hereafter "beta casein"), and gelatin from porcine skin. All three proteins were obtained from Sigma Chemical Co. of St. Louis, Mo. The Sigma designation for these proteins are: beta casein—catalog no. C-6905, lot no. 12H9550; fibrinogen—catalog no. F-4753, lot no. 112H9334, Fraction I, Type IV (a mixture of 15% sodium citrate, 25% sodium chloride and 58% protein); and gelatin—Type I, 300 bloom, lot no. 35F-0676.

Solvents for solubilizing these proteins included: deionized-distilled water; a solution of 99.5% deionized, distilled water and 0.5% hexanol; and a pH buffered solution.

The protein solutions were formulated by adding a quantity of the protein source as provided by the above vendors to one of the above described solvents. For example, a 0.2 mg/ml solution of fibrinogen was prepared by adding 0.2 mg of the Sigma's catalog no. F-4753, lot no. 112H9334, Fraction I, Type IV formulation per milliliter of solvent.

Generally, the protein solution was stirred for about one hour before the polymeric fabric was immersed therein. With regards to the gelatin solution, the gelatin solution was heated to between about 60° to 70° C. in order to dissolve the gelatin. After the gelatin was dissolved, the solution was allowed to cool to room temperature (around 25° C.) before being used.

Once solubilized in one of the previously described solvents, the protein was then allowed to contact a polymeric fabric. This was achieved by immersing the polymeric fabric into the solution containing the solubilized protein and maintaining the polymeric fabric in such solution for a specified period of time.

In an effort to demonstrate the effect of exposing the protein-contacted polymeric fabric to ultrasonic frequencies, some of the polymeric fabrics were merely immersed in the protein solution for a specific period of time and then removed. Upon removal of the polymeric fabric from the protein solubilized solution, the polymeric fabric was permitted to air dry. Generally, data relative to the polymeric fabrics which were merely immersed in the protein solution for a specific period of time and then removed are reported in the TABLES labeled "SOAKING".

In other instances, the immersed polymeric fabrics were exposed to ultrasonic frequencies for a particular time interval and then removed. Upon removal of the polymeric fabric from the protein solution, the polymeric fabric was permitted to air dry. Generally, data relative to the polymeric fabrics which were immersed in the protein solution and exposed to ultrasonic frequencies are reported in the TABLES labeled "SONICATION". Though not reported in the TABLES, polymeric fabrics were sonicated in the buffer solution without protein. In these instances, the wettability ratings for these polymeric fabrics was 1.

In both instances, ESCA measurements of the protein-contacted polymeric fabrics were collected to identify the presence of protein, if any, on these fabrics. The amount of atomic nitrogen and oxygen or the nitrogen/carbon atomic ratios indicated the presence of protein on these fabrics. Generally, ESCA data are reported in the TABLES labeled "ESCA DATA".

The water wettability of several of the protein-contacted polymeric fabrics was evaluated. The TABLES include an abbreviated expression corresponding to each of these polymeric fabrics along with other data, which are described in greater detail below, relative to each such polymeric fabric. The following is a key to the abbreviated expression for each polymeric fabric reported in the TABLES. Generally, these abbreviations appear under columns labeled "SUBSTRATE".

| | |
|---|---|
| MB-1 | Is a 1.5 ounce per square yard (osy) meltblown polypropylene web. The polypropylene resin was labeled PF-015 and was obtained from Himont. The melt flow index (grams/10 minutes) was specified to be 400. The meltblown web was determined by scanning electron microscopy to have an average fiber diameter of 3.2 microns. |
| MB-2 | Is a 0.5 osy meltblown polypropylene web formed from PF-015. |
| MB-3 | Is a 50 grams per square meter (gsm) meltblown polyethylene web produced from DOW Chemical Company's linear low density polyethylene (LLDPE) ASPUN 6831A 150 melt flow index resin. |
| MB-4 | Is a 159 gsm polyethylene meltblown web produced from DOW Chemical Company's LLDPE ASPUN 6831A, 150 melt flow index resin. |
| SB-1 | Is a 0.8 osy spunbond polypropylene web. |
| SB-2 | Is a polyethylene/polypropylene sheath/core 2.5 osy, 0.7 denier per filament (dpf) spunbond web. The polyethylene resin was DOW Chemical Company's ASPUN 6831A, 150 melt flow index resin. The polypropylene had a melt flow index of 100 and was obtained from SHELL. |
| SB-3 | Is a polyethylene/polypropylene side-by-side 3.0 osy, 1.2 dpf spunbond web. The polyethylene resin was DOW Chemical Company's 6811, 30 melt flow index resin. The polypropylene was EXXON 3445, 34 melt flow index resin. |
| SB-4 | Is a polyethylene/polypropylene side-by-side 2.5 osy, 1.1 dpf spunbond web. The polyethylene was DOW Chemical Company's 6811, 30 melt flow index resin. The polypropylene was EXXON 3445, 34 melt flow index resin. |
| FILM-1 | Is a 2.0 mil polypropylene film. Edison Plastics Co., type no. XP715 S/P, LOT/EPC no. 46805. |
| FILM-2 | Is a 2.0 mil polyethylene film. Edison Plastics Co., type no. XP716 S/E, LOT/EPC no. 46806. |
| COFORM | Is a 70/30 polypropylene/cellulose pulp, 150 gsm web. This web was formed by the process described in U.S. Pat. No. 4,818,464, which is herein incorporated by reference and was generally prepared using the conditions listed below. The polypropylene fibers were formed from Himont PF015 polypropylene. The cellulose pulp was Weyerhauser NF405 cellulose pulp. |

COFORM FORMING CONDITIONS

| | Extr #1 | Extr #2 |
|---|---|---|
| PP Pump Rate (RPM) | 12 | 12 |
| Zone 1 Temp | 300° F. | 300° F. |
| Zone 2 Temp | 370° F. | 370° F. |
| Zone 3 Temp | 420° F. | 420° F. |
| Zone 4 Temp | 480° F. | 480° F. |
| Zone 5 Temp | 500° F. | 500° F. |
| Zone 6 Temp | 500° F. | 500° F. |
| Extruder Melt Temp | 517° F. | 510° F. |
| Hose Temp | 500° F. | 500° F. |
| Adapter Temp | 500° F. | 500° F. |

-continued

| | | |
|---|---|---|
| Spin Pump Body Temp | 500° F. | 500° F. |
| Die Zone 1 | 500° F. | 500° F. |
| Die Zone 2 | 500° F. | 500° F. |
| Die Zone 3 | 500° F. | 500° F. |
| Die Zone 4 | 500° F. | 500° F. |
| Die Tip Melt Temp | 505° F. | 508° F. |
| Primary Air Temp | — | — |
| Extruder Pressure | 300 | 150 |
| Spin Pump Pressure | 147 | 139 |
| Adapter Pressure | 300 | 300 |
| Melt Pressure | 110 | 320 |
| Primary Air Pressure | 7 | 7 |
| Prim Air Htr 20" line | 570 | — |
| Primary Air Heater | — | — |
| Primary Air Flow 2 | 470 | — |
| CET Feed rpm | 7 | — |
| Line Speed fpm | 213 | — |
| Die Angles | 48° | 49° |
| Tip to Tip Distance | 6 ¾" | 6 ¾" |
| Tip to Wire Distance | 12 ¾" | 11 ½" |
| Forming Height | — | |
| CET Duct to Wire Dist | 18 ½" | |
| Under Wire Zone 1 | 0 | |
| Under Wire Zone 2 | −4 | |
| Under Wire Zone 3 | −16 | |
| Under Wire Zone 4 | −15 | |
| Under Wire Zone 5 | −3 | |
| Under Wire Zone 6 | −6 | |

Note: All Pressures are in pounds per square inch (psi).

Water wettability ratings for each of the polymeric fabrics are indicated by a number from between 1 to 5 and generally reported in the TABLES under columns labeled "WETTABILITY". These numeric values relate to the observed interaction of a single drop of deionized, distilled water (approximately 1/20 ml) in contact with the protein-treated polymeric fabric during various time intervals. The following is a key to these numeric values.

5=Penetration in ≦1 sec.

4.5=Penetration in ~2–10 sec.

4=Penetration in ~10–60 sec.

3=Completely spread after 1 min.

2=Moderate spreading after 1 min.

1.5=Slightly spread after 1 min.

1=Remained beaded after 1 min.

For example, if a single drop of deionized, distilled water was applied to the surface of a polymeric fabric and such drop of water was observed to completely penetrate the polymeric fabric after 45 seconds of contacting the fabric, the water wettability value for such polymeric fabric would be "4". Furthermore, in those instances where several drops of deionized, distilled water were applied to the surface of the polymeric fabric, each drop was applied to a different location on the surface of the polymeric fabric.

Solutions of individual proteins and the particular solvents for each such solution are reported in the TABLES under columns labeled "PROTEIN SOLUTION". The particular proteins are identified at the top of each TABLE. Under the columns labeled "PROTEIN SOLUTION" the concentration of the protein, i.e. 0.2 mg/ml, is reported first, followed by an abbreviation identifying the solvent. The following is a key to the solvent abbreviations.

| | |
|---|---|
| DIW | Deionized-distilled water prepared according to ASTM "Standard Specification for Reagent Water" 1991 (D1193-91, Test Method #7916) |
| HEX | A solution of 99.5% deionized, distilled water and 0.5% hexanol. |
| IPA | A solution of 99% isopropanol. |
| Buf. | A pH buffered solution of deionized, distilled water containing 20 milliMolar dibasic sodium phosphate (Sigma, catalog no. S-0876, lot 52H0684) |

In TABLE XI, which reports ESCA data for polymeric fabrics treated with the protein gelatin, the protein solution and the conditions under which the polymeric fabrics were contacted by the protein solution are abbreviated and reported under columns labeled "TREATMENT". The following is a key to these abbreviations.

| | |
|---|---|
| Untreated | The polymeric fabric was not contacted by either a protein or one of the above described solvents. |
| W-soak | The polymeric fabric was immersed for 5 minutes in a gelatin solution that was manually stirred with a glass stirring rod. The solution contained 0.2 mg of gelatin per milliliter of the above described buffer solution. |
| H-soak | The polymeric fabric was immersed for 5 minutes in a gelatin solution that was manually stirred with a glass stirring rod. The solution contained 0.2 mg of gelatin per milliliter of a 0.5% hexanol, 99.5% deionized, distilled water solution. |
| W-Son 30 | The polymeric fabric was secured between a pair of concentric engaging rings and immersed in a gelatin solution of 0.2 mg of gelatin per milliliter of the above buffer solution. Once immersed, each side of the polymeric fabric was positioned about 1 inch below the tip of the horn and sonicated for 30 seconds at 145 watts. |
| W-Son 120 | The polymeric fabric was secured between a pair of concentric engaging rings and immersed in a gelatin solution of 0.2 mg of gelatin per milliliter of the above buffer solution. Once immersed, the each side of the polymeric fabric was positioned about 1 inch below the tip of the horn and sonicated for 120 seconds at 145 watts. |

The ultrasonic frequency source used in these EXAMPLES was a Branson Model 450 Sonifier® ultrasonic frequency generator. The Branson Model 450 Sonifier® ultrasonic frequency generator produced horn frequencies of between 19.850 and 20.050 kHz. This ultrasonic frequency generator was fitted with a ¾ inch diameter high gain horn, model no. 101-147-035.

For all sonication data, the power output from the ultrasonic frequency generator is reported in watts under the columns labeled "OUTPUT". The watt values were determined by recording a manually selected output setting of between 1 and 10 on the power supply and a resulting meter reading of between 1 and 100 on the power supply when the horn was immersed in solution and activated. The output setting and the power supply reading were then correlated with a graph supplied by Branson to arrive at a watt value. Additionally, after sonication, the temperature of some of the protein solutions was measured. In these instances, the temperature of these solutions after sonication did not exceed 45° C.

For the sonication data reported in TABLES VI, VII (RUNS 8 and 9) and XI (RUNS 3, 7 and 8), the polymeric fabric was secured between two engaging surfaces, such as a 3 inch diameter wooden embroidery hoop, and immersed into the protein solution. The volume of protein solution used in these instances was between about 1,500 to 2,000 ml. The horn was mounted on a support structure and positioned generally perpendicular to the polymeric fabric. The support structure was vertically adjustable within the protein solution. Generally, the tip of the horn extended a distance of between ½ inch and 1½ inches into the protein solution. Generally, the distance between the tip of the horn and the polymeric fabric was between ¼ inch and 1 inch.

For sonication data shown in TABLES IV, V, VII (RUNS 1–7 and 10), VIII (RUNS 3 and 4), IX (RUNS 3, 4, 5, and 6) and X (RUNS 3 and 4), the horn was mounted on a support structure which was vertically adjustable within the protein solution. Generally, the tip of the horn extended a distance of between ½ inch and 1½ inches into the protein solution. The volume of protein solution used in these instances was between about 450 to 650 ml. The immersed polymeric fabrics were not secured in the protein solution. A glass stirring rod was used during activation of the ultrasonic frequency generator to gently move the polymeric fabrics within the protein solution so that a portion of the polymeric fabrics was generally positioned below and in vertical alignment with the tip of the horn.

Additionally, in several "COMMENTS" columns in the TABLES, the phrase "... % fabric wetted out" appears. This phrase is used to express the percentage of the polymeric fabric, including both the surface of the fabric and the bulk of the fabric, which, after being contacted with the protein solution, appeared to be wet with the protein solution.

OBSERVATIONS

TABLES I–III report the water wettability results for various polymeric fabrics which were merely soaked in various protein solutions. TABLE I reports the water wettability results for polymeric fabrics soaked in beta casein solutions. TABLE II reports the water wettability results for polymeric fabrics soaked in gelatin solutions. And TABLE III reports the water wettability results for polymeric fabrics soaked in fibrinogen solutions.

TABLE I

SOAKING BETA CASEIN

| RUN | SUBSTRATE | PROTEIN SOLUTION | SOAK TIME | DROPS/ WETTABILITY |
|---|---|---|---|---|
| 1 | MB-1 | 0.2 mg/ml - Buf. | 5 min. | 8/1–2 |
| 2 | MB-1 | 1.0 mg/ml - Hex | 5 min. | 7/4 |
| 3 | MB-1 | 0.1 mg/ml - Hex | 5 min. | 4/3 |
| 4 | MB-1 | 0.75 mg/ml - Hex | 5 min. | 4/4.5 |
| 5 | SB-1 | 1.0 mg/ml - Hex | 5 min. | 4/3 |
| 6 | SB-1 | 1.0 mg/ml - Hex | 60 min. | 4/4.5 |
| 7 | SB-1 | 1.0 mg/ml - Buf. | 5 min. | 6/3 |
| 8 | SB-1 | 1.0 mg/ml - Buf. | 60 min. | 4/4.5 |
| 9 | SB-1 | 1.0 mg/ml - Buf. | 5 min. | 10/3 |
| 10 | SB-1 | 1.0 mg/ml - Buf. | 60 min. | 3/3 |

TABLE II

SOAKING GELATIN

| RUN | SUBSTRATE | PROTEIN SOLUTION | SOAK TIME | DROPS/ WETTABILITY | COMMENTS |
|---|---|---|---|---|---|
| 1 | MB-1 | 0.2 mg/ml Buf. | 5 min. | 6/1.5 | Only fabric surface appeared wet |
| 2 | MB-1 | 0.2 mg/ml Buf. | 5 min. | 6/1.5 | Only fabric surface appeared wet |
| 3 | FILM-2 | 0.2 mg/ml Buf. | 1 min. | — | Contact angle of DIW = 66° Untreated FILM-2, Contact angle of DIW = 92° |

TABLE III

SOAKING FIBRINOGEN

| RUN | SUBSTRATE | PROTEIN SOLUTION | SOAK TIME | DROPS/ WETTABILITY | COMMENTS |
|---|---|---|---|---|---|
| 1 | MB-1 | 0.2 mg/ml - Buf. | 5 min. | 5/1.5 | Soaked in a solution that was previously used to apply protein on fabrics with sonication. |
| 2 | MB-1 | 0.2 mg/ml - Buf. | 10 min | 15/1 | Solution was not used to apply protein on fabrics with sonication. |
| 3 | MB-1 | 0.2 mg/ml - IPA | 5 min. | 8/1 | |
| 4 | MB-1 | 0.2 mg/ml - Hex | 5 min. | 8/1.5, 7/1 | |
| 5 | MB-1 | 1.0 mg/ml - Hex | 5 min. | 7/1 | |
| 6 | MB-1 | 0.1 mg/ml - Hex | 5 min. | 4/1 | |

TABLE III-continued

| RUN | SUBSTRATE | PROTEIN SOLUTION | SOAKING FIBRINOGEN SOAK TIME | DROPS/ WETTABILITY | COMMENTS |
|---|---|---|---|---|---|
| 7 | MB-1 | 0.2 mg/ml - Hex | 10 min. | 4/1 | NOTE |
| 8 | MB-1 | 0.5 mg/ml - Hex | 10 min. | 4/1 | NOTE |

NOTE: Protein solutions was sonicated for 15–30 seconds before the polymeric fabric was soaked therein. Sonicating instrument was a Janke/Kunkel IKA ® Labortechnik, Ultra Turrax T25 at a setting of between 8,000 to 9,500.

With regards to the beta casein soaking data reported in TABLE I, the polymeric fabrics analyzed were MB-1 (1.5 osy polypropylene meltblown fabric), and SB-1 (0.8 osy polypropylene spunbond fabric). Generally, MB-1 or SB-1 after contact with 0.75 and 1.0 mg/ml beta casein/hexanol solutions for 5 minutes had the best wettability ratings. MB-1 after contact with either the 0.1 and 0.2 mg/ml beta casein/hexanol and beta casein/buffer solutions, respectively, had lower wettability ratings.

With regards to the gelatin data reported in TABLE II, the water wettability rating for MB-1 after contact with the 0.2 mg/ml gelatin/buffer solution was 1.5.

With regards to the fibrinogen data reported in TABLE III, the water wettability rating for MB-1 after contact with solutions of 1.0, 0.5, 0.2 and 0.1 mg/ml of fibrinogen/hexanol was between 1 and 1.5. Also, the water wettability rating for MB-1 after contact with a solution of 0.2 mg/ml of fibrinogen/buf. was 1.5. Note, in runs 6 and 7, the fibrinogen solution was sonicated before the polymeric fabric samples were immersed in these solutions.

TABLES IV–VII report the water wettability results wherein the polymeric fabrics were contacted by various protein solutions and exposed to ultrasonic frequencies.

TABLE IV

| RUN | SUBSTRATE | PROTEIN SOLUTION | SONICATION BETA CASEIN TIME | OUTPUT (WATTS) | DROPS/ WETTABILITY | COMMENTS |
|---|---|---|---|---|---|---|
| 1 | MB-1 | 0.2 mg/ml Buf. | 5 min. | 75 | 8/4 | 100% fabric wetted out |
| 2 | MB-1 | 0.2 mg/ml Buf. | 5 min. | 152 | 4/4* | 100% fabric wetted out |
| 3 | MB-1 | 0.2 mg/ml DIW | 5 min. | 63 | 7/4 | 100% fabric wetted out |
| 4 | MB-1 | 0.2 mg/ml DIW | 5 min. | 152 | 4/4** | 100% fabric wetted out |

*The fabric from RUN 2 was soaked in 80 ml of deionized/distilled water for about one (1) day. After removal from the water soak and drying, the wettability of this fabric was tested. The wettability rating was 1.
**The fabric from RUN 4 was soaked in 80 ml of deionized/distilled water for about three (3) days. After removal from the water soak and drying, the wettability of this fabric was tested. The wettability rating was 1.

TABLE V

| RUN | SUBSTRATE | PROTEIN SOLUTION | SONICATION GELATIN TIME | OUTPUT (WATTS) | DROPS/ WETTABILITY | COMMENTS |
|---|---|---|---|---|---|---|
| 1 | MB-1 | 0.2 mg/ml Buf. | 5 min. | 75 | 8/5* | 100% fabric wetted out |
| 2 | MB-1 | 0.2 mg/ml Buf. | 5 min. | 110 | 8/4.5–5 | 100% fabric wetted out |
| 3 | MB-1 | 0.2 mg/ml Buf. | 5 min. | 152 | 8/4.5–5** | 100% fabric wetted out |
| 4 | MB-1 | 0.2 mg/ml Buf. | 2.5 min. | 152 | 8/4.5–5 | 100% fabric wetted out |

*The fabric from RUN 1 was soaked in 80 ml of deionized/distilled water for about 1 (1) day. After removal from the water soak and drying, the wettability of this fabric was tested. The wettability rating was 4–5.
**The fabric from RUN 3 was soaked in 80 ml of deionized/distilled water for about 1 (1) day. After removal from the water soak and drying, the wettability of this fabric was tested. The wettability rating was 4.5–5.

TABLE VI

| RUN | SUBSTRATE | PROTEIN SOLUTION | TIME | SONICATION GELATIN OUTPUT (WATTS) | DROPS/ WETTABILITY | COMMENTS |
|---|---|---|---|---|---|---|
| 1 | MB-2 | 0.2 mg/ml Buf. | 30 sec. | 145 | 3/4 | |
| 2 | SB-1 | 0.2 mg/ml Buf. | 30 sec. | 145 | 7/1.5–2 | |
| 3 | 3-SB-1 | 0.2 mg/ml Buf. | 30 sec. | 145 | | Three pieces of SB-1 were stacked one on top of the other. After sonication, the SB-1 pieces were separated and the water wettability tested: top SB-1 - 6/2; middle SB-1 - 7/2; bottom SB-1 - 6/2 |
| 4 | SB-1 | 0.2 mg/ml Buf. | 30 sec. | 145 | 6/1.5–2 | Fabric was positioned between the horn and a sheet of FILM 1 |
| 5 | FILM-1 | 0.2 mg/ml Buf. | 30 sec. | 145 | — | Contact angle of deionized, distilled water on treated film: 55° Contact angle of deionized, distilled water on untreated film: 94° |
| 6 | SB-2(Side A) | 0.2 mg/ml Buf. | 30 sec. | 145 | 4/4 | |
| | SB-2(Side B) | 0.2 mg/ml Buf. | 30 sec. | 145 | 4/4 | |
| 7 | SB-3 | 0.2 mg/ml Buf. | 31 sec. | 145 | 4/4–4.5 | |
| 8 | SB-3 | 0.2 mg/ml Buf. | 30 sec. | 145 | 4/4–4.5 | |
| 9 | SB-4 | 0.2 mg/ml Buf. | 30 sec. | 145 | 6/4.5 | |
| 10 | SB-4 | 0.2 mg/ml Buf. | 30 sec. | 145 | 6/4 | |
| 11 | MB-4 | 0.2 mg/ml Buf. | 30 sec. | 145 | 12/1 | |
| 12 | MB-4 | 0.2 mg/mi Buf. | 30 sec. | 145 | 10/1 | |
| 13 | MB-3 | 0.2 mg/ml Buf. | 30 sec. | 145 | 8/1 | |
| 14 | MB-3 | 0.2 mg/ml Buf. | 30 sec. | 145 | 6/1.5–2 | |
| 15 | FILM-2 | 0.2 mg/ml Buf. | 30 sec. | 145 | — | Contact angle cf DIW on treated film: 58° Contact angle of DIW on untreated film: 92° |
| 16 | COFORM | 0.2 mg/ml Buf. | 30 sec. | 145 | 4/5 | |
| 17 | COFORM | 0.2 mg/ml Buf. | 30 sec. | 145 | 4/5 | |

TABLE VII

| RUN | SUBSTRATE | PROTEIN SOLUTION | TIME | SONICATION FIBRINOGEN OUTPUT (WATTS) | DROPS/ WETTABILITY | COMMENTS |
|---|---|---|---|---|---|---|
| 1 | MB-1 | 0.2 mg/ml Buf. | 5 min. | 18 | 5/1.5 | About 1% of fabric wetted out |
| 2 | MB-1 | 0.2 mg/ml Buf. | 5 min. | 62 | 3/4, 2/1.5 | 30% of fabric wetted out |
| 3 | MB-1 | 0.2 mg/ml Buf. | 5 min. | 110 | 2/4.5, 3/4 | 100% fabric wetted out |
| 4 | MB-1 | 0.2 mg/ml Buf. | 5 min. | 75 | 6/4.5, 2/4 | 95% of fabric wetted out |
| 5 | MB-1 | 0.2 mg/ml Buf. | 2.5 min. | 152 | 5/4 | 100% fabric wetted out |
| 6 | SB-1 | 0.2 mg/ml Buf. | 2.5 min. | 75 | 5/1 | 100% fabric wetted out |
| 7 | SB-1 | 0.2 mg/ml Buf. | 2.5 min. | 152 | 5/1 | 100% fabric wetted out |
| 8 | MB-1 | 0.2 mg/ml Buf. | 8 sec. | 75 | 2–3/4.5 | An area of fabric under horn wetted out (Zone 1) |
| 9 | MB-1 | 0.2 mg/ml Buf. | 4 sec. | 110 | 2–3/4.5 | An area of fabric under horn wetted out (Zone 2) The area of fabric outside Zones 1 & 2 was not wettable (wettability rating = 1) |
| 10 | MB-1 | 0.2 mg/ml Buf. | 2 min. | 152 | 6/4–4.5* | 100% fabric wetted out |

*The fabric from RUN 8 was soaked in 80 ml of deionized/distilled water for about 1 (1) day. After removal from the water soak and drying, the wettability of this fabric was tested. The wettability rating was 4.

With regards to the beta casein sonication data reported in TABLE IV, the water wettability rating for MB-1 after contact with a solution of 0.2 mg/ml of beta casein was 4. In all four runs, the MB-1 fabric was 100% wet with the protein solution after sonication. However, the significant loss of wettability after one and three days of soaking in deionized, distilled water suggest that the beta casein is somewhat fugitive.

With regards to the gelatin sonication data reported in TABLE V, the water wettability rating for MB-1 after contact with a solution of 0.2 mg/ml of gelatin was between 4.5 and 5. In all four runs, the MB-1 fabric was 100% wet with the protein solution after sonication. Additionally, after soaking in deionized, distilled water for 24 hours, gelatin-treated polymeric fabric showed little if any loss of wettability.

With regards to the gelatin sonication data reported in TABLE VI, the water wettability rating for SB-1, MB-3 (50 gsm polyethylene meltblown) and MB-4 (159 gsm polyethylene meltblown) after contact with a solution of 0.2 mg/ml of gelatin was between 1 and 2. The water wettability rating for MB-2, SB-2 (polyethylene/polypropylene sheath/core 2.5 osy spunbond), SB-3 (polyethylene/polypropylene side-by-side 3.0 osy spunbond), SB-4 (polyethylene/polypropylene side-by-side 2.5 osy spunbond) and COFORM after contact with a solution of 0.2 mg/ml of gelatin was between 4 and 5.

With regards to the fibrinogen sonication data reported in TABLE VII, the water wettability rating for MB-1 after contact with a solution of 0.2 mg/ml of fibrinogen and sonicated at 18 watts was generally around 1.5. Portions of the fabric from RUN 2 had a wettability rating of 4. The wettability rating for MB-1 after contact with a solution of 0.2 mg/ml of fibrinogen and sonicated at or above 75 watts was generally between 4 and 4.5. The wettability rating for SB-1 after contact with a solution of 0.2 mg/ml of fibrinogen (0.8 osy polypropylene spunbond) and sonicated at 75 and 152 watts was 1. With regards to RUN 10, after soaking in deionized, distilled water for 24 hours, the fibrinogen-treated polymeric fabric showed some loss of wettability. RUNs 8 and 9 demonstrate that applying a protein by sonication can produce polymeric fabrics having zoned wettability.

TABLES VIII–X report the ESCA data for polymeric fabrics which were merely soaked in a protein solution and for polymeric fabrics which were exposed to ultrasonic frequencies in various protein solutions. It should be noted under the column heading "SOAK/SONIC." data appears, such as "5/No" and "No/5-152". "5/No" means that the polymeric fabric was soaked for 5 minutes in the protein solution without sonication. "No/5-152" means that the polymeric fabric was sonicated for 5 minutes at 152 watts in the protein solution. Furthermore, the gathered data reported in these TABLES correspond to "RUN" pairs. For example, in TABLE VIII, RUN 1 evaluated an MB-1 fabric which was soaked for 5 minutes in the protein solution. In RUN 2, a MB-1 fabric was soaked for 5 minutes in the protein solution, dried, and then further soaked for 24 hours in a deionized, distilled water bath ("24 hr DIW"). By considering the data of odd/even RUN pairs (RUN pairs: 1-2, 3-4, and 5-6) reported in TABLES VIII–X, comparisons relative to the amount of protein applied by soaking vs. sonication can be made as well as the surface tension effects, if any, to an aqueous solution after a 24 hour period of exposure to a protein-treated polymeric fabric. It will further be noted that the ESCA data shows two measurements, each taken from a separate location on the protein-treated fabric. The deionized, distilled water surface tension data (DIW SURFACE TENSION SOAK) is the average of two measurements taken from the same water sample.

TABLE VIII

ESCA DATA
BETA CASEIN

| RUN | SUBSTRATE | PROTEIN SOLUTION | SOAK/ SONIC. | OTHER TREATMENT | % N | % O | % C | N/C | DIW TENSION Pre | SURFACE SOAK Post |
|---|---|---|---|---|---|---|---|---|---|---|
| 1 | MB-1 | 0.2 mg/ml-Buf. | 5/No | — | 10.2 | 15.3 | 72.5 | 0.14 | — | — |
| | | | | | 11.7 | 16.9 | 69.4 | 0.17 | | |
| 2 | MB-1 | 0.2 mg/ml-Buf. | 5/No | 24 hr DIW | 9.3 | 12.4 | 77.6 | 0.12 | 70.5 | 70.4 |
| | | | | | 9.4 | 12.3 | 77.4 | 0.12 | | |
| 3 | MB-1 | 0.2 mg/ml-Buf. | No/5-152 | — | 8.8 | 13.8 | 75.2 | 0.12 | — | — |
| | | | | | 8.6 | 14.5 | 74.6 | 0.12 | | |
| 4 | MB-1 | 0.2 mg/ml-Buf. | No/5-152 | 24 hr DIW | 6.4 | 9.5 | 82.6 | 0.08 | 70.5 | 70.4 |
| | | | | | 8.9 | 12.7 | 76.8 | 0.12 | | |

TABLE IX

ESCA DATA
GELATIN

| RUN | SUBSTRATE | PROTEIN SOLUTION | SOAK/ SONIC. | OTHER TREATMENT | % N | % O | % C | N/C | DIW TENSION Pre | SURFACE SOAK Post |
|---|---|---|---|---|---|---|---|---|---|---|
| 1 | MB-1 | 0.2 mg/ml-Buf. | 5/No | — | 10.6 | 14.1 | 73.9 | 0.14 | — | — |
| | | | | | 6.8 | 13.1 | 77.8 | 0.09 | | |
| 2 | MB-1 | 0.2 mg/ml-Buf. | 5/No | 24 hr DIW | 5.4 | 8.4 | 85.8 | 0.06 | 70.6 | 69.6 |
| | | | | | 11.0 | 13.2 | 75.4 | 0.14 | | |
| 3 | MB-1 | 0.2 mg/ml-Buf. | No/5–75 | — | 14.0 | 18.4 | 65.7 | 0.21 | — | — |
| | | | | | 11.9 | 16.6 | 69.4 | 0.17 | | |
| 4 | MB-1 | 0.2 mg/ml-Buf. | No/5–75 | 24 hr DIW | 13.0 | 15.8 | 69.9 | 0.19 | 70.9 | 70.3 |
| | | | | | 11.0 | 14.8 | 72.1 | 0.15 | | |
| 5 | MB-1 | 0.2 mg/ml-Buf. | No/5-152 | — | 12.7 | 17.5 | 68.1 | 0.19 | — | — |
| | | | | | 13.3 | 17.6 | 67.4 | 0.20 | | |
| 6 | MB-1 | 0.2 mg/ml-Buf. | No/5-152 | 24 hr DIW | 11.9 | 15.0 | 71.9 | 0.16 | 70.7 | 70.2 |
| | | | | | 13.3 | 15.8 | 70.0 | 0.20 | | |

TABLE X

| RUN | SUBSTRATE | PROTEIN SOLUTION | SOAK/ SONIC. | OTHER TREATMENT | ESCA DATA FIBRINOGEN % N | % O | % C | N/C | DIW TENSION Pre | SURFACE SOAK Post |
|---|---|---|---|---|---|---|---|---|---|---|
| 1 | MB-1 | 0.2 mg/ml-Buf. | 5/No | — | 11.6 | 17.8 | 67.8 | 0.17 | — | — |
| | | | | | 10.9 | 17.6 | 68.6 | 0.16 | | |
| 2 | MB-1 | 0.2 mg/ml-Buf. | 5/No | 24 hr DIW | 10.1 | 13.7 | 75.3 | 0.13 | 70.4 | 70.2 |
| | | | | | 12.2 | 15.6 | 71.3 | 0.17 | | |
| 3 | MB-1 | 0.2 mg/ml-Buf. | No/2–152 | — | 11.1 | 17.7 | 68.4 | 0.16 | — | — |
| | | | | | 13.2 | 19.1 | 64.8 | 0.20 | | |
| 4 | MB-1 | 0.2 mg/mi-Buf. | No/2–152 | 24 hr DIW | 12.5 | 17.0 | 68.9 | 0.18 | 70.4 | 70.1 |
| | | | | | 12.5 | 17.0 | 69.3 | 0.18 | | |

With regards to the beta casein ESCA data reported in TABLE VIII, the nitrogen/carbon ratios (N/C) are relatively similar for MB-1 fabrics which were soaked for 5 minutes in the protein solution and for MB-1 fabrics which were soaked for 5 minutes in the protein solution, dried, and then placed in a water bath for 24 hours. Additionally, the nitrogen/carbon ratios are relatively similar for MB-1 fabrics which were sonicated for 5 minutes in the protein solution and for MB-1 fabrics which were sonicated for 5 minutes in the protein solution, dried, and then placed in a water bath for 24 hours. Finally, there was very little difference in the surface tension of the water between pre- and post- 24 hour soakings.

Similar trends described above for beta casein were found in the gelatin ESCA data reported in TABLE IX and in the fibrinogen ESCA data reported in TABLE X. With regards to the ESCA measurements for RUN 1, the variances in these measurements suggest that soaking a polymeric article in a gelatin solution does not produce a protein coating as uniform as the protein coating obtained by sonicating the polymeric article in the gelatin solution.

TABLE XI reports the ESCA data, water wettability results and treatment conditions for SB-2, SB-3, SB-4, MB-3, MB-4 and COFORM polymeric fabrics exposed to various gelatin protein solutions and treatment conditions.

TABLE XI

| RUN | SAMPLE | TREATMENT | ESCA DATA GELATIN % N | % O | % C | N/C | WETTABILITY (DROPS/RATING) |
|---|---|---|---|---|---|---|---|
| 1 | MB-3 | Untreated | 0.2 | 3.2 | 95.6 | 0.002 | 14/1 |
| 2 | MB-3 | W-soak | 8.4 | 12.8 | 77.0 | 0.11 | 14/1–1.5 |
| | | | 10.0 | 14.8 | 73.5 | 0.14 | |
| 3 | MB-3 | W-Son 30 | 8.2 | 13.4 | 77.0 | 0.11 | 4/3–4 "front side" |
| | | | 6.7 | 11.6 | 80.4 | 0.08 | 5/1–1.5 "back side" |
| 4 | MB-4 | Untreated | 0.0 | 0.5 | 99.3 | 0 | 14/1 |
| 5 | MB-4 | W-soak | 9.0 | 12.2 | 77.1 | 0.12 | 14/1 |
| | | | 9.3 | 13.0 | 76.5 | 0.12 | |
| 6 | MB-4 | H-soak | 5.7 | 7.3 | 86.4 | 0.07 | 12/1 |
| | | | 5.1 | 6.5 | 88.1 | 0.06 | |
| 7 | MB-4 | W-Son 30 | 9.9 | 13.4 | 75.6 | 0.13 | 12/1–1.5 |
| | | | 9.7 | 13.3 | 75.6 | 0.13 | |
| 8 | MB-4 | W-Son 120 | 7.5 | 11.4 | 79.8 | 0.09 | 26/1 |
| | | | 6.5 | 10.3 | 82.1 | 0.08 | |
| 9 | SB-2 | Untreated | 0.0 | 0.3 | 99.7 | 0 | 10/1 |
| 10 | SB-2 | W-soak | 12.4 | 15.9 | 70.4 | 0.18 | 14/1–1.5 |
| | | | 10.8 | 14.9 | 73.0 | 0.15 | |
| 11 | SB-3 | Untreated | 0.0 | 0.6 | 99.3 | 0 | 10/1 |
| 12 | SB-3 | W-soak | 12.6 | 16.7 | 69.0 | 0.18 | 6/1.5–4 "front side" |
| | | | 10.1 | 14.7 | 73.8 | 0.14 | 6/1–1.5 "back side" |
| 13 | SB-3 | H-soak | 7.4 | 9.2 | 83.3 | 0.09 | 12/1 |
| | | | 9.6 | 11.9 | 78.2 | 0.12 | |
| 14 | SB-4 | Untreated | 0.0 | 0.7 | 99.1 | 0 | 10/1 |
| 15 | SB-4 | W-soak | 10.3 | 14.1 | 74.0 | 0.14 | 7/1.5–2 "front side" |
| | | | 11.4 | 15.9 | 71.0 | 0.16 | 6/1.5 "back side" |
| 16 | Coform | Untreated | 0.0 | 2.3 | 97.5 | 0 | 12/1 |
| 17 | Coform | W-soak | 9.1 | 12.8 | 76.9 | 0.12 | 12/1–1.5 |
| | | | 7.7 | 13.0 | 77.6 | 0.10 | |

Note: If there was a difference in wettability for one side versus the other side, then the wettability rating is reported as "front" and "back" side.

CONCLUSIONS

It is clear from the above EXAMPLES and data that the water wettability of a polymeric fabric is improved by bringing a polymeric article into physical contact with a protein in a solution and exposing the protein-contacted polymeric article to a frequency. Additionally, proteins may be applied to the polymeric article very rapidly and more uniformly than by merely soaking the polymeric article in a protein solution. Furthermore, the process of the present invention permits zoning of the protein treatment on the polymeric article, and thus permits zoning the wettability of selected areas of the polymeric article.

While the invention has been described in detail with respect to specific embodiments thereof, it will be appreciated that those skilled in the art, upon attaining an understanding of the foregoing, may readily conceive of alterations to, variations or and equivalents to these embodiments. Accordingly, the scope of the present invention should be assessed as that of the appended claims and any equivalents thereto.

We claim:

1. A process for applying a protein to a hydrophobic polymer to obtain a hydrophilic surface on said hydrophobic polymer, the process comprising the steps of:

bringing the hydrophobic polymer into physical contact with a solution of a protein; and exposing the solution of a protein to a frequency of at least 5 kHz, wherein the frequency is produced by a frequency source comprising a horn having a tip, and wherein the tip of the horn is in physical contact with the solution of a protein and is either in physical contact with the hydrophobic polymer or is spaced a distance of up to 3 inches from the hydrophobic polymer.

2. The process of claim 1 wherein the tip of the horn is in physical contact with the hydrophobic polymer.

3. The process of claim 1 wherein the frequency is an ultrasonic frequency.

4. The process of claim 1 wherein the protein is selected from the group consisting of casein, fibrinogen, gelatin, hemoglobin, and lysozyme.

5. The process of claim 1 wherein the solution is a pH buffer solution.

6. The process of claim 1 wherein the hydrophobic polymer is a polyolefin.

7. The process of claim 6 wherein the polyolefin is a polypropylene.

8. A process for applying a protein to a shaped hydrophobic polymeric material to obtain a hydrophilic surface on said shaped hydrophobic polymeric material, the process comprising the steps of:

bringing the shaped hydrophobic polymeric material into physical contact with a solution of a protein; and exposing the solution of a protein to a frequency of at least 5 kHz, wherein the frequency is produced by a frequency source comprising a horn having a tip, and wherein the tip of the horn is in physical contact with the solution of a protein and is either in physical contact with the shaped hydrophobic polymeric material or is spaced a distance of up to 3 inches from the shaped hydrophobic polymeric material.

9. The process of claim 8 wherein the tip of the horn is in physical contact with the shaped hydrophobic polymeric material.

10. The process of claim 8 wherein the frequency is an ultrasonic frequency.

11. The process of claim 8 wherein the protein is selected from the group consisting of casein, fibrinogen, gelatin, hemoglobin, and lysozyme.

12. The process of claim 8 wherein the solution is a pH buffer solution.

13. The process of claim 8 wherein the shaped hydrophobic polymeric material is a polyolefin.

14. The process of claim 13 wherein the polyolefin is a polypropylene.

15. A process for applying a protein to a fibrous nonwoven web formed from a hydrophobic polymer to obtain a hydrophilic surface on said fibrous nonwoven web, the process comprising the steps of:

bringing the fibrous nonwoven web into physical contact with a solution of a protein; and exposing the solution of a protein to a frequency of at least 5 kHz, wherein the frequency is produced by a frequency source comprising a horn having a tip, and wherein the tip of the horn is in physical contact with the solution of a protein and is either in physical contact with the fibrous nonwoven web or is spaced a distance of up to 3 inches from the fibrous nonwoven web.

16. The process of claim 15 wherein the frequency is an ultrasonic frequency.

17. The process of claim 15 wherein the protein is selected from the group consisting of casein, fibrinogen, gelatin, hemoglobin, and lysozyme.

18. The process of claim 15 wherein the solution is a pH buffer solution.

19. The process of claim 15 wherein the hydrophobic polymer is a polyolefin.

20. The process of claim 19 wherein the polyolefin is a polypropylene.

21. A process for converting a polyolefin nonwoven web to a wettable nonwoven web capable of absorbing 1/20 milliliter of water in less than 60 seconds, the process comprising the steps of:

bringing the polyolefin nonwoven web into physical contact with a solution of a protein; and exposing the solution of a protein to a frequency of at least 5 kHz, wherein the frequency is produced by a frequency source comprising a horn having a tip, and wherein the tip of the horn is in physical contact with the solution of a protein and is either in physical contact with the polyolefin nonwoven web or is spaced a distance of up to 3 inches from the polyolefin nonwoven web.

22. The process of claim 21 wherein the frequency is an ultrasonic frequency.

23. The process of claim 21 wherein the polyolefin nonwoven web is a meltblown nonwoven web.

24. The process of claim 21 wherein the polyolefin nonwoven web is a polypropylene meltblown nonwoven web.

25. A process for applying a protein to a fibrous nonwoven web formed from a hydrophobic polymer in order to render said fibrous nonwoven web wettable with water and capable of absorbing 1/20 milliliter of water in less than 60 seconds, the process comprising the steps of:

bringing the fibrous nonwoven web into physical contact with a solution of a protein, wherein the concentration of the protein in solution is less than 0.1 percent by weight based on the weight of the solution; and exposing the solution of a protein to an ultrasonic frequency in the range of between about 19 kHz to about 21 kHz, wherein the ultrasonic frequency is produced by an ultrasonic frequency source comprising a horn having a tip, and wherein the tip of the horn is in physical contact with both the solution of the protein and the fibrous nonwoven web.

* * * * *